United States Patent [19]

Hohorst et al.

[11] Patent Number: 5,038,005

[45] Date of Patent: Aug. 6, 1991

[54] ELECTRIC PLUG DEVICE WITH PHASE SELECTION

[75] Inventors: Wolfgang Hohorst; Hans J. Köllmann, both of Minden, Fed. Rep. of Germany

[73] Assignee: Wago Verwaltungsgesellschaft, Minden, Fed. Rep. of Germany

[21] Appl. No.: 348,182

[22] Filed: May 1, 1989

[30] Foreign Application Priority Data

May 25, 1988 [DE] Fed. Rep. of Germany ..... 3818078

[51] Int. Cl.[5] ..... H01R 21/00

[52] U.S. Cl. ..... 200/51.06; 200/51.12

[58] Field of Search ..... 200/51.06, 51.05, 51.02, 200/51.03, 51.12, 504

[56] References Cited

U.S. PATENT DOCUMENTS 664,971 1/1901 Riordan ..... 200/51.06 X
2,914,639 11/1959 Freeland ..... 200/504
3,181,086 4/1965 McCutcheon et al. ..... 200/504 X
4,666,223 5/1987 Tillmann ..... 200/51.06 X

FOREIGN PATENT DOCUMENTS

0241318A2 10/1987 European Pat. Off. .
1640482B2 7/1977 Fed. Rep. of Germany .
2716964B2 8/1980 Fed. Rep. of Germany .
3501917C1 7/1986 Fed. Rep. of Germany .

*Primary Examiner*—Renee S. Luebke
*Attorney, Agent, or Firm*—Salter & Michaelson

[57] ABSTRACT

This invention concerns a plug device with phase selection, especially as a plug connector for track lights, and the problem is addressed of making such a plug device economically, with the smallest structural dimensions, and with the lowest internal resistances. This is achieved by a contact unit consisting of a connecting contact and a contact arm, which can be deformed by torsion and/or bending to contact different internal contact tap surfaces in the device.

2 Claims, 3 Drawing Sheets

Fig. 7
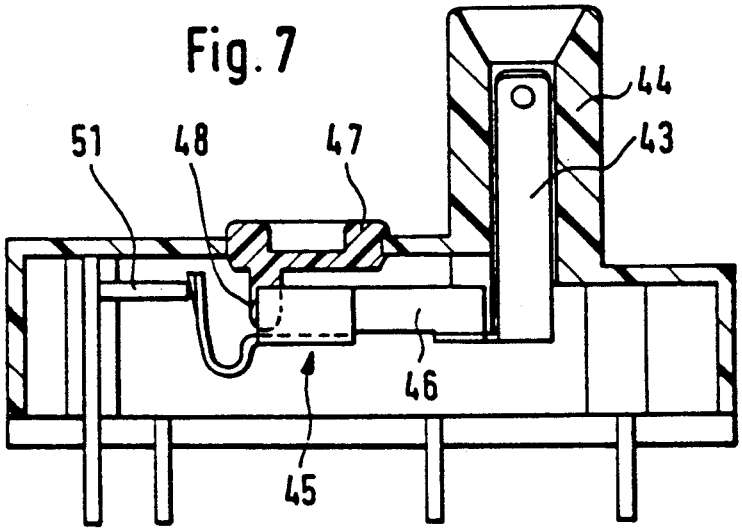
Fig. 8
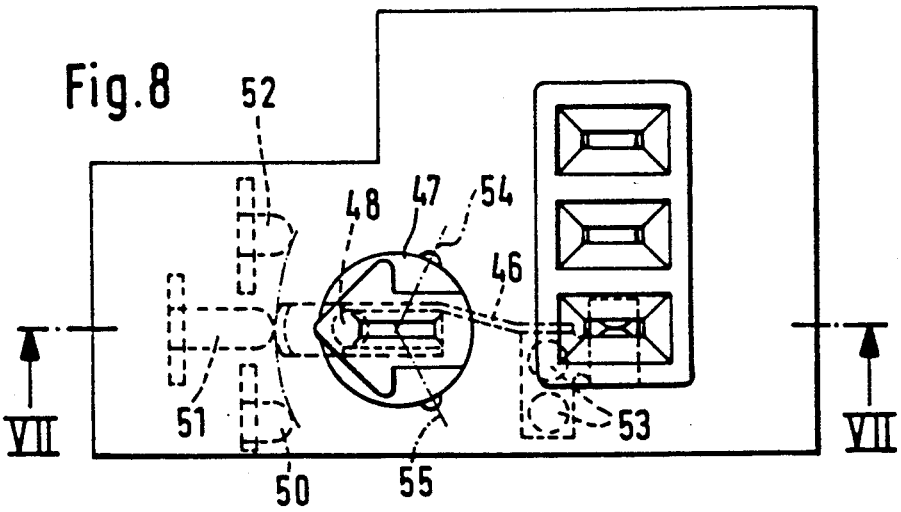
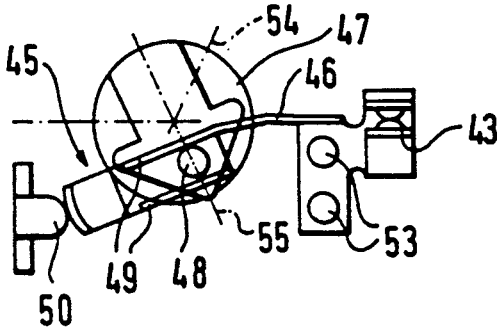
Fig. 9

ELECTRIC PLUG DEVICE WITH PHASE SELECTION

BACKGROUND AND SUMMARY OF THE INVENTION

This invention concerns a plug device with phase selection that has a connector contact, for example as a socket contact, plug contact, or contact point of any design, that can selectively be connected electrically to the contact tap surfaces of at least two phase-transmission conductors by means of a switch integrated into the plug device and through a spring contact arm.

Such plug devices with phase selection are used particularly as plug-in connectors for track lights. In track lights, a fivepin flat cable (ground conductor, neutral conductor, and three phase conductors) is usually laid as transmission wiring in a track that is used to insert a number of lights. The ground conductor, the neutral conductor, and a specific phase conductor of the flat cable are contacted separately by a plug device for each light. The electrician has to decide on the spot which of the available phase conductors is contacted to achieve the most uniform line load possible, or for example, to guarantee the lighting of industrial shops or the like in case of the failure of one phase of the power source, by switching the installed lights over to another phase conductor.

For the electrician to be able to make this phase selection readily on the spot, one design possibility that has been proposed is to integrate a switch into the plug device, for example a rotary switch or a slide switch. However, this has the drawback that such a switch that has to be installed between the phase connector contact for the light and the contact tap surfaces of the individual phase-transmission conductors, increases the costs of the plug device to be produced by mass production, and requires substantially larger structural dimensions of the plug device, and also degrades the internal resistances inside the plug device, since the proposed selection switches always operate with an additional sliding contact.

It is therefore the purpose of this invention to provide a plug device with phase selection that can be produced economically and with small structural dimensions, with the internal resistances inside the plug device being kept as small as possible.

According to the teaching of the invention, when the connector contact of the plug device that is intended for the phase connection of the lights is made integral with a spring contact arm that can be deformed elastically by torsion and/or bending, then this unit consisting of the connector contact and the contact arm constitutes the smallest possible design of a selector switch, and at the same time it is free of any additional internal resistances, such as those otherwise familiar in a switch in the form of sliding contacts.

Possible design details of the plug device are described below in greater detail with reference to the drawings.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 7 is a sectional view of a fourth embodiment of the plug device taken along line VIII—VIII in FIG. 8.

FIG. 8 is a top plan view thereof; and

FIG. 9 is a view illustrating an alternate position of the contact arm thereof.

DESCRIPTION OF THE INVENTION

Figure 1:
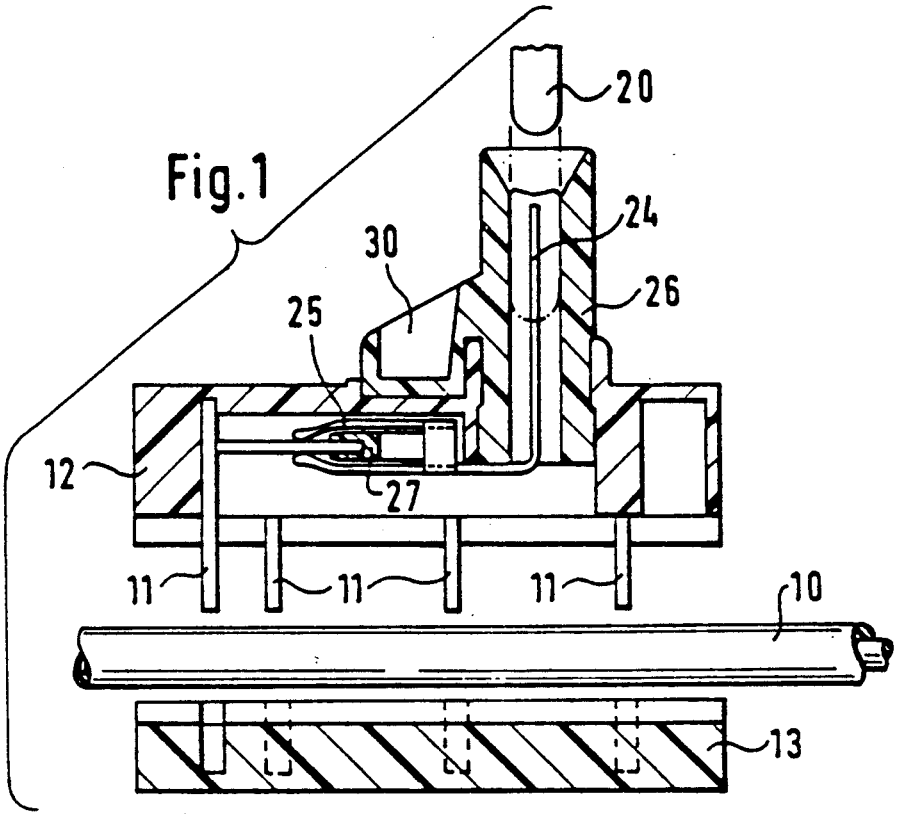
FIG. 1 is a sectional view of a first embodiment of the plug device of the instant invention taken along line I—I in FIG. 2.
Figure 2:
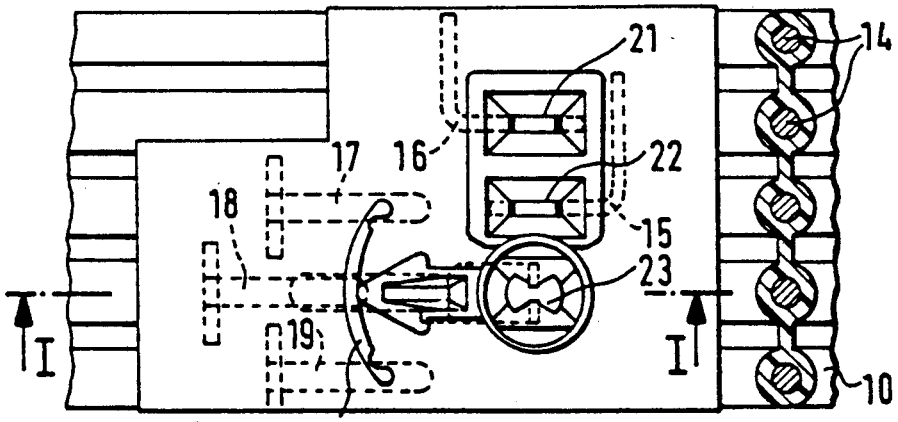
FIG. 2 is a top plan view thereof.

FIGS. 1 and 2 as an example show half a plug device that consists of an upper case section 12 and a lower case section 13. These parts are pressed onto the fivepin flat cable 10 illustrated, with the knife connectors 11, that have a U-shape, penetrating the insulating jacket of the flat cable 10 and contacting the metallic conductor wires 14 of the flat cable. This technique of knife connection is known and provides perfect contacting of the individual conductors of the flat cable 10. This makes available so-called contact tap surfaces inside the upper section 12 of the plug device, namely the contact tap surface 15 for the ground conductor, the contact tap surface 16 for the neutral conductor, and the contact tap surfaces 17, 18, and 19 for the three phases of the power supply.

The half plug device illustrated is designed as a socket component and only one plug tab 20 from the associated plug component of the plug device is indicated in FIG. 1, which is plugged into the particular jack contacts 21, 22 and 23 when the plug device is plugged together. This technique is also known.

Only the jack contact 23, that is used as the phase-connection contact for connecting the light, is important for the invention. This connecting contact can be selectively connected electrically to one of the illustrated contact tap surfaces 17, 18, 19 of the phase-transmission conductors of the flat cable 10.

Figure 3A:
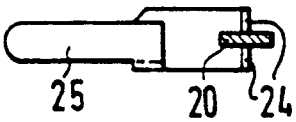
FIG. 3*a*, 3*b* and 3*c* are views illustrating the different positions of the contact arm thereof.
Figure 3B:
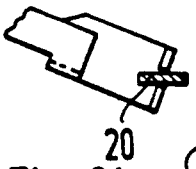
Figure 3C:
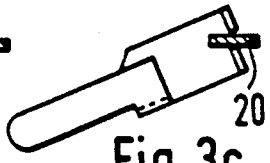

For this purpose, pursuant to the invention, it is suggested that the connecting contact 23 be designed in the form of a fork contact 24 that is aligned as the socket component perpendicular to the flat plug-in tab 20 as a plug component, and that the length of the fork slit of the fork contact be chosen so that the fork contact 24 can pivot around the plug axis of the plug-in tab 20 by torsion and tilting of the ends of the fork. FIGS. 3*a*–3*c* show this more precisely.

FIG. 3*a* shows the fork contact 24 in its central normal position, in which it is aligned essentially exactly perpendicular to the flat plug-in tab 20. In this normal position, the contact arm 25, which is integral with the fork contact 24, contacts the contact tap surface 18, as best seen in FIG. 2.

If the contact arm 25 is to contact the contact tap surface 17 of the other phase conductor, then the contact arm 25 is pivoted around the plug axis of the plug-in tab 20 in the appropriate direction, as shown in FIG. 3*b*. The fork ends of the fork contact 24 are merely twisted and slightly tilted, as can be seen easily in the top view of FIG. 3*b*.

If the contact arm 25 is to contact the contact tap surface 19 of the other phase conductor, then pivoting occurs correspondingly in the other direction, as shown in FIG. 3*c*.

It is important in this embodiment for the fork ends of the connecting contact 24 to be positioned coaxially in a switch case 26, which is mounted to rotate in the insulator case of the plug device (see FIG. 1), and for the contact arm 25 extending radially to be fixed, i.e., fastened rigidly, to the base of the switch case 26, to contact the contact tap surfaces 17, 18, and 19.

Because of this, the axis of rotation of the selector switch or of the switch case 26 lies coaxially in the plug axis of the plug-in tab 20, which remains immovably in place when the switch case 26 rotates. The rotary process of the selector switch and of the switch case 26 is thereby reduced to the twisting and tilting of the fork ends of the connecting contact 24 already mentioned. Thus, the current conduction always present in a plug device when plugging the plug component into the socket component is used at the same time so that the socket component can rotate around the plug component for purposes of phase selection without the need for an additional sliding contact for this purpose, which is the case in known selector switches.

FIG. 1 shows the possibility of the contact arm 25 contacting each of the contact tap surfaces 17, 18, and 19 from above and below in phase selection. The internal resistances between the contact arm and the contact tap surfaces are thereby reduced to a minimum. To facilitate the switching process, the contact tap surfaces are aligned relative to one another using an insulator guide element 27.

Figure 4:
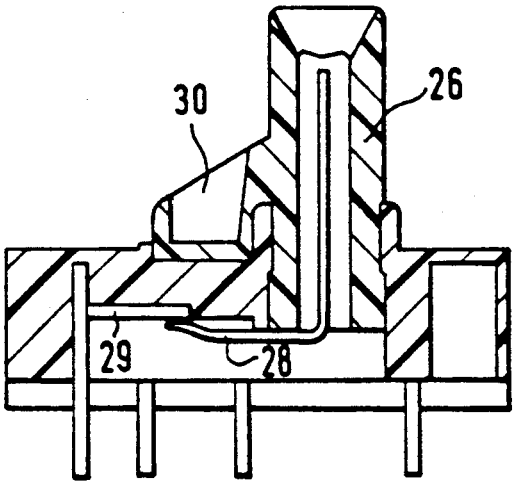
FIG. 4 is a sectional view of a second embodiment of the plug device.

FIG. 4 shows a simplified design in comparison with the form of embodiment of FIGS. 1–3, which is provided by the contact arm 28 contacting the contact tap surfaces 29 supported against the insulator case from only one side, namely from below. Otherwise, the structural details of FIG. 4 are essentially the same as those of the form of embodiment of FIGS. 1 and 2, so that the description will not be repeated.

Both the form of embodiment of FIG. 4 and that of FIGS. 1 and 2 provide that the switch case 26 is rotated by the electrician on the spot in the simplest way for phase selection, by inserting his screwdriver into the opening 30 provided for this, and bringing the arrow visible from FIG. 2 into the position corresponding to his phase selection, in which the point of the arrow latches into the particular selected position in a fastening device 31.

Figure 5:
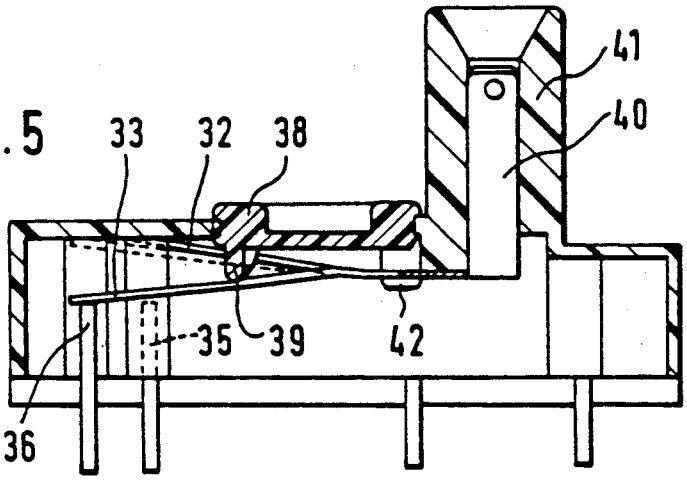
FIG. 5 is a sectional view of a third embodiment of the plug device taken along line V—V in FIG. 6.
Figure 6:
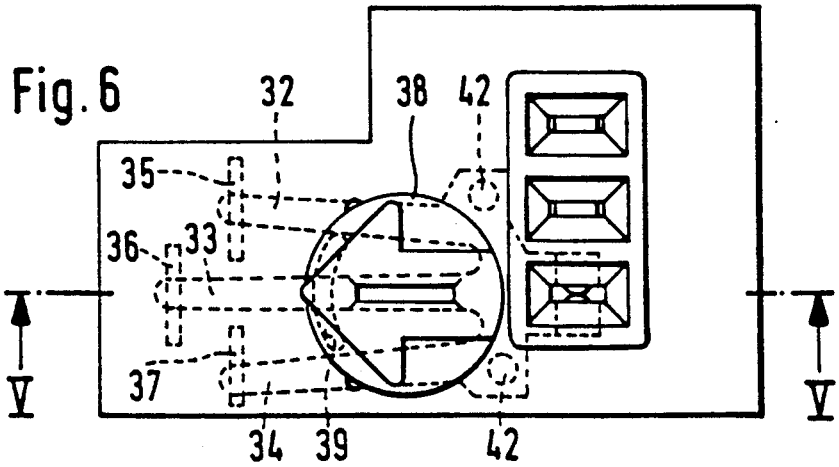
FIG. 6 is a top plan view thereof.

FIGS. 5 and 6 show a third form of embodiment of the invention in which the contact arm has contact fingers 32, 33, and 34 corresponding to the number of phase-transmission conductors, each of which extends beyond one of the contact tap surfaces 35, 36, 37 associated with the phase-transmission conductors.

A rotary insulator disk 38 overlapping all of the contact fingers is mounted to rotate above the contact fingers in the insulator case of the plug device, which selectively presses one of the contact fingers against the contact tap surface associated with the contact finger when it rotates, by means of a cam 39 projecting downward against the contact fingers, which has appropriate slanted shoulders.

In the illustration according to FIGS. 5 and 6, the central contact finger 33 is pressed against the contact tap surface 36. The two other contact fingers 32 and 34 are not actuated.

In this form of embodiment of the invention, the connecting contact 40 is positioned in a normal, nonrotating socket guard collar 41. The connecting contact 40 is again integral with the contact arm fingers 32, 33 and 34, and is fastened in the insulator case of the illustrated plug device, for example, by means of plastic rivets 42. For phase selection, the rotary insulator disk 38 only has to be turned in the direction described.

FIGS. 7–9 show a fourth example of embodiment of the invention, in which again the connecting contact 43 is placed in a normal, nonrotating socket guard collar 44. The connecting contact 43 is integral with the contact arm 45, which has a special bending area 46 that can be deformed elastically like a leaf spring perpendicular to the axis of rotation of a rotary disk 47. For this purpose, a peg 48 of the rotary disk 47 engages in a driver guide 49 of the contact arm, as best seen in FIG. 9. Depending on the selected position of rotation of the rotary disk 47, the free contact end of the contact arm 45 contacts one of the contact tap surfaces 50, 51, 52, which are associated with the particular phase-transmission conductors, as has been described earlier in detail in connection with FIGS. 1 and 2.

In the example of embodiment according to FIGS. 7 to 9, the contact unit consisting of the connecting contact 43 and the contact arm 45 is again fastened in the insulator case of the plug device by plastic rivets 53, with a restoring torque from the elastically deformed contact arm acting on the rotary disk through the rotary peg 48, depending on the selected position of rotation of the rotary disk 47, i.e., the phase selection. To overcome this restoring torque, in accordance with a further beneficial form of embodiment of the invention, it is suggested that the contact tap surfaces 50, 51, 52 be positioned relative to the contact arm 45 so that starting from a central position of rotation of the rotary disk, as shown in FIG. 8, the other positions of rotation of the rotary disk in which the contact tap surfaces 50 and 52 are contacted, are reached only after the rotary disk passes a dead point in which the direction of the arrow of the rotary disk points toward the centerlines 54 and 55 illustrated. This holds the rotary disk 47 and the phase selection in place, and requires no other additional locking device.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A plug device comprising an insulator case having at least one plug receiving socket formed therein for receiving a plug-in tab of a plug connector, and having at least first and second spaced conductor wire connector means for independently contacting first and second conductor wires of first and second phase transmission wires, respectively, said first and second conductor wire connector means including first and second contact tap surfaces, respectively, locate in said insulator case, and contact means in said insulator case communicating with said socket for contacting said plug-in tab when the latter is received therein, said contact means being integrally formed from a resilient conductive metal and being resiliently deformable when said plug-inn tab is received in said socket for movement between a first position wherein said contact means contacts said plug-in tab and said first contact tap surface but not said second contact tap surface, and a second position wherein said contact means contacts said plug-in tab and said second contact tap surface but not said first contact tap surface, said contact means comprising a bifurcated fork contact having spaced first and second resilient fork legs, said fork contact being positioned in said socket for receiving said plug-in tab in electrical contact between said fork legs, said plug-in tab having a longitudinal axis, said fork contact being pivotable about the axis of said plug-in tab when the latter is received in said socket by resiliently twisting and tilting said fork legs to move said contact means between said first and second positions thereof.

2. In the device of claim 1, said insulator case including an upper case section and a switch case section, said plug receiving socket being formed in said switch case section, said switch case section being pivotable relative to said upper case section about a pivot axis, said pivot axis being substantially coaxial with said plug-in tab axis when said plug-in tab is received in said socket, said fork contact being positioned such that said fork legs are substantially parallel to said pivot axis and substantially uniformly spaced on opposite sides thereof, said contact means further comprising a contact arm extending substantially radially outwardly from said fork contact relative to said pivot axis for alternatively contacting said first contact tap surface or said second contact tap surface.

* * * * *